United States Patent [19]

Gates

[11] 4,158,452

[45] Jun. 19, 1979

[54] CLAMPING LOCK FOR LOOPED TIES

[75] Inventor: H. Gordon Gates, Denver, Colo.

[73] Assignee: Gates & Sons, Inc., Denver, Colo.

[21] Appl. No.: 887,941

[22] Filed: Mar. 20, 1978

Related U.S. Application Data

[63] Continuation-in-part of Ser. No. 815,186, Jul. 13, 1977, abandoned.

[51] Int. Cl.[2] ..... E04G 17/08

[52] U.S. Cl. ..... 249/45; 249/46; 249/47; 249/191; 249/216; 249/219 R

[58] Field of Search ..... 249/40–47, 249/190, 191, 213, 214, 216, 217, 219 R, 192

[56] References Cited

U.S. PATENT DOCUMENTS

| | | | |
|---|---|---|---|
| 2,296,782 | 9/1942 | Fischer et al. | 249/192 |
| 2,600,362 | 6/1952 | Harder | 249/191 |
| 3,067,479 | 12/1962 | Schimmel | 249/41 |
| 3,141,224 | 7/1964 | Gates | 249/217 |
| 3,437,306 | 4/1969 | Gates | 249/43 |

*Primary Examiner*—Roy Lake
*Assistant Examiner*—John McQuade
*Attorney, Agent, or Firm*—Sheridan, Ross, Fields & McIntosh

[57] ABSTRACT

A clamping lock is provided for use with a looped tie in a form for settable casting compositions, such as concrete, which lock is provided with protrusions on each of a pair of clamping members to fit into aligned connector slots of a pair of rails of adjacent panels of the form to properly position and firmly secure the lock to the form. The securing of the clamping members on the rails also holds adjacent panels of the form together. The rails are provided with tie notches which when panels are placed side by side and properly aligned the tie notches form tie slots through which a tie having loops at each end can be extended between panels of opposing sides or walls of the form structure. A tie opening is formed in the clamping lock through which the loop of a tie is adapted to extend. An anchor lock having a tapered arm is mounted on the clamping lock so that its arm can enter into a tie loop extending through the tie opening to secure the tie to the clamping lock and to tension the tie. Various means are provided to secure the clamping members against the rails.

50 Claims, 24 Drawing Figures

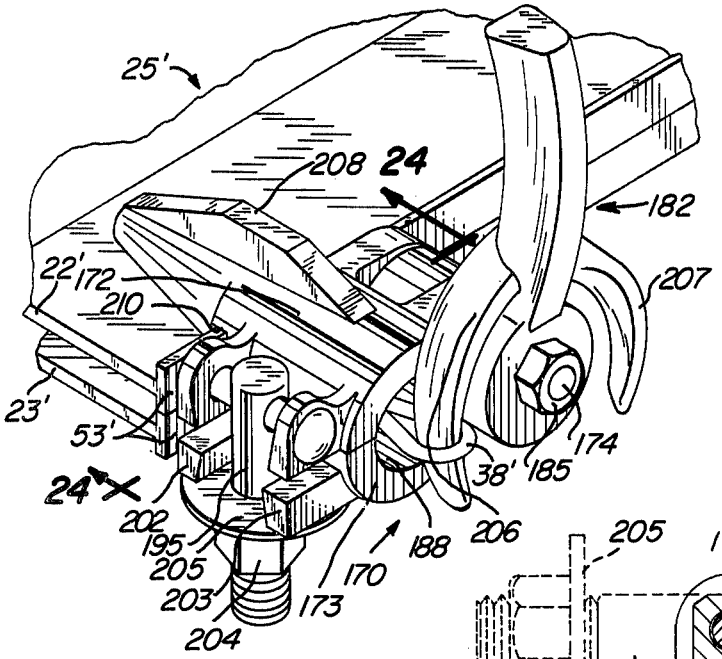
Fig- 22
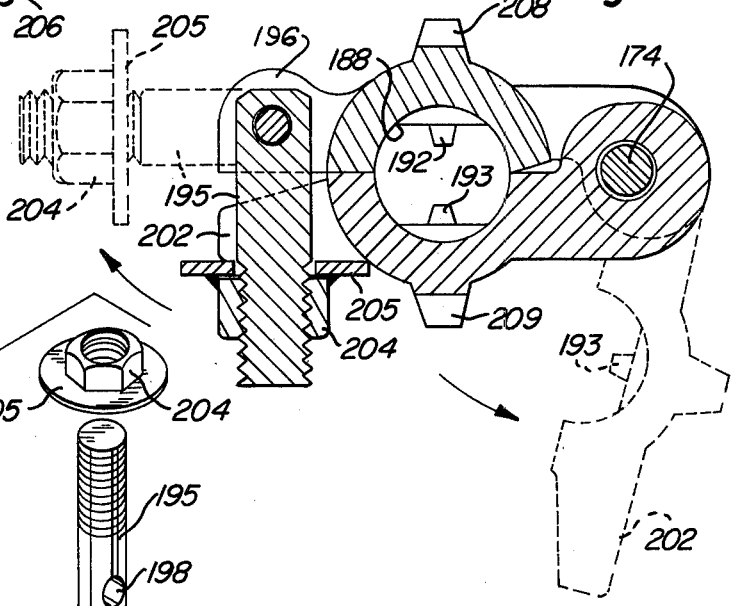
Fig-24
Fig- 23
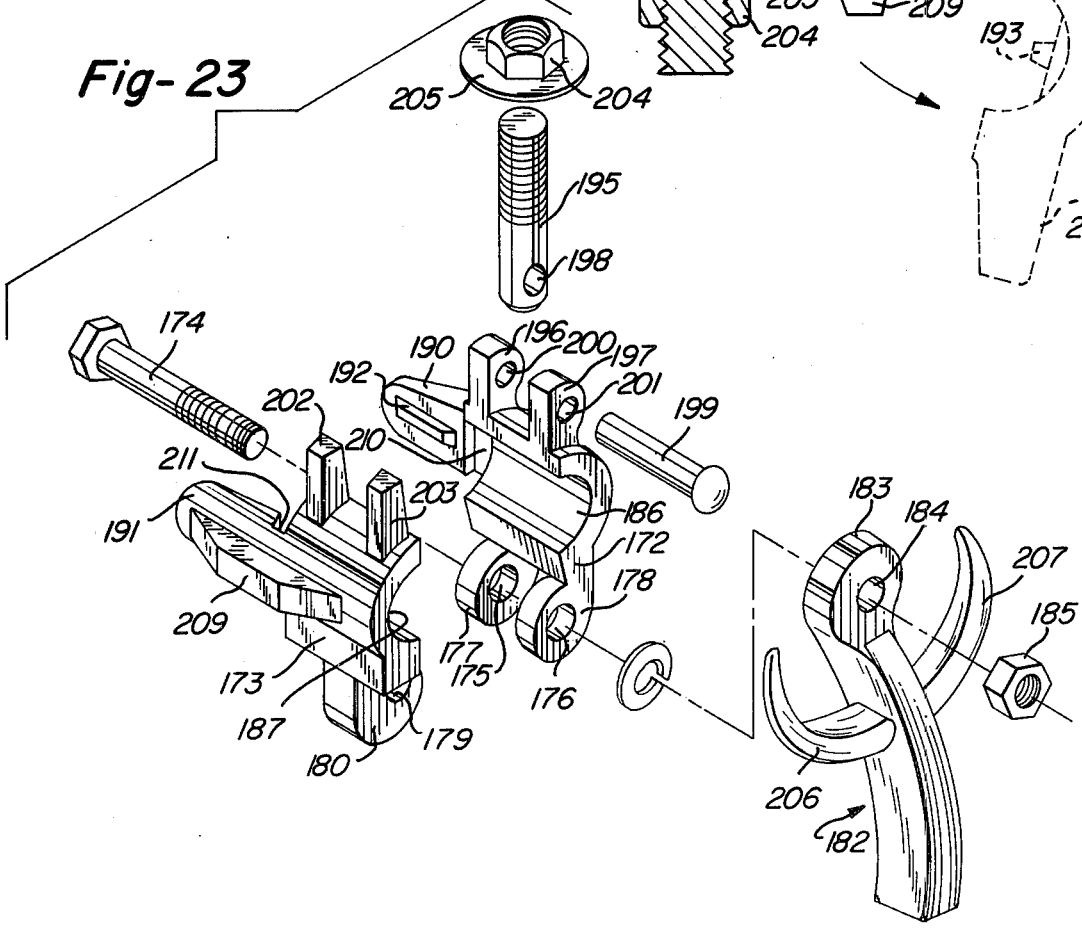

CLAMPING LOCK FOR LOOPED TIES

This application is a continuation-in-part of my copending application, U.S. Ser. No. 815,186 filed July 13, 1977, now abandoned.

BACKGROUND OF THE INVENTION

1. Field of the Invention

This invention is in the field of devices for securing looped ties to a form for settable casting compositions, such as concrete, so that the form can resist the weight of the concrete poured into it and prior to the pouring of the concrete to maintain opposed walls of the form properly spaced.

2. Description of the Prior Art

Forms for vertical wall concrete castings have generally been built from wood or steel or both. For many years the construction industry has erected such forms by interconnecting, or fastening together, a plurality of panels. Each such panel, in a widely used commercial embodiment, has a plywood facing with four steel rails which are welded together to form a rectangular frame. The welded steel frame is secured to the perimeter of the facing. Reinforcing steel cross members are provided between rails. Such panels are available in standard sizes of 4, 6 and 8 feet in height and with a standard width of 2 feet. Filler panels are available to make up odd lengths of walls.

The rails have a pair of contact flanges on each side of their web and the flanges are oriented outwardly from each panel so that the contact flanges provide two areas of contact when two panels are set side by side and are secured to one another in the process of erecting the walls of a form.

To connect adjacent aligned panels, connector slots are formed in the webs of the rails. These connector slots are uniformly spaced so that when two such panels are placed side by side and in proper alignment their connector slots are aligned. The panels of one wall can then be secured together by a wedge key which is inserted through a pair of opposed and aligned connector slots of the pair of rails between adjacent panels. A second identical wedge key fits into a slot in the first to secure the first wedge key in the rails and thus the adjacent pair of panels together. As panels are assembled to erect the walls of a form a looped tie is secured to the rails of adjacent pairs of panels with the ties preferably being uniformly spaced. The spacing of the ties is determined by the speed of the pour and the height of the form. To secure a tie to the panels, the rails are provided with tie notches which are also uniformly spaced in the same manner as the connector slots so that when the rails of two panels are aligned and fastened together their tie notches form tie slots. The relationship between the connector slots and tie slots of a pair of rails of connected panels is that lines through the centers of corresponding pairs of tie slots and connector slots will be substantially perpendicular to one another and intersect one another.

When a looped tie, a tie having a loop at each end, is to be connected between two pairs of panels of opposing walls of a form, a tie is inserted through the tie slots between a pair of rails of adjacent panels of one wall and a wedge key is inserted through the connector slots and the loop to fasten that end or loop of the tie to the pair of panels. The first wedge key is locked in place by a second similar wedge key driven into the slot of the first.

Similarly, the other loop of the tie is secured to the rails between a pair of panels of the opposite wall of the form.

One of the problems of the prior art associated with the use of pairs of wedge keys to secure looped ties to the rails of panels in opposing walls of a form is that large numbers of such wedge keys are needed. Since they are relatively small and are not secured together, the rate of loss of such devices is particularly high. In addition the insertion of such wedges through the connector slots and loop of a tie positioned between a pair of rails is difficult to do quickly and efficiently. Another problem with the prior art is that the loops of a looped tie are between the rails when locked in place so that the panels must be removed to break off, or break back, the ends of the tie within the concrete after it has set.

SUMMARY OF THE INVENTION

The present invention provides an improved clamping lock for looped ties which can be used with prior art steel framed panels which are in widespread use in the construction industry. A pair of clamping members with each member having a jaw, is positioned astride a pair of rails with the rails between the jaws of the members. Each jaw may be provided with a projection which fits into one of a pair of aligned opposing connector slots of a pair of rails of properly positioned adjacent panels. Means are provided to force the clamping member against the rails to secure the clamping lock to the rails, to properly position the lock on the rails, and to force or clamp the rails together. In one form of the invention this means may include a bolt interconnecting the clamping members. In another form, a wedge key may be used. In still another form of the invention a swing bolt is utilized. A tie opening is provided between the clamping means which is aligned with the tie slots of the rails. Tie fastening means are mounted on a clamping member and are adapted to enter into a loop of a looped tie in the tie opening, a portion of which loop extends beyond the tie opening of the clamping means to secure the loop to the clamping lock and to apply force to tension a tie between panels of opposing walls of such a form.

It is, therefore, an object of this invention to provide a clamping lock for looped ties for use in settable casting combination form which reduces the number of parts needed to construct a given form.

It is another object of this invention to provide clamping locks for a looped tie which reduce the time required to connect the clamping locks to the form and to secure a loop of the tie to the clamping locks.

It is still another object of this invention to provide an improved clamping lock for a looped tie used in a settable casting combination form in which the means for clamping the lock to the rails of adjacent panels properly position the lock with respect to tie slots formed by such rails so that a tie can be quickly positioned in the form structure and locked in place.

It is still another object of this invention to provide a clamping lock in which each loop of a looped tie projects beyond the lock to facilitate the breaking back of the ends of the tie.

BRIEF DESCRIPTION OF THE DRAWINGS

Other objects, features and advantages of the invention will be readily apparent from the following description of certain preferred embodiments thereof taken in conjunction with the accompanying drawings, although variations and modifications may be effected without departing from the spirit and scope of the novel concepts of the disclosure, and in which:

FIG. 22 is a perspective view, similar to FIG. 1 but showing an alternative form of clamping lock utilizing a swing bolt to clamp the clamping members against the rails;

FIG. 23 is an exploded perspective view of the clamping lock of FIG. 22; and

FIG. 24 is an enlarged horizontal section, taken along line 24 of FIG. 22.

DESCRIPTION OF THE PREFERRED EMBODIMENT

Figure 1:
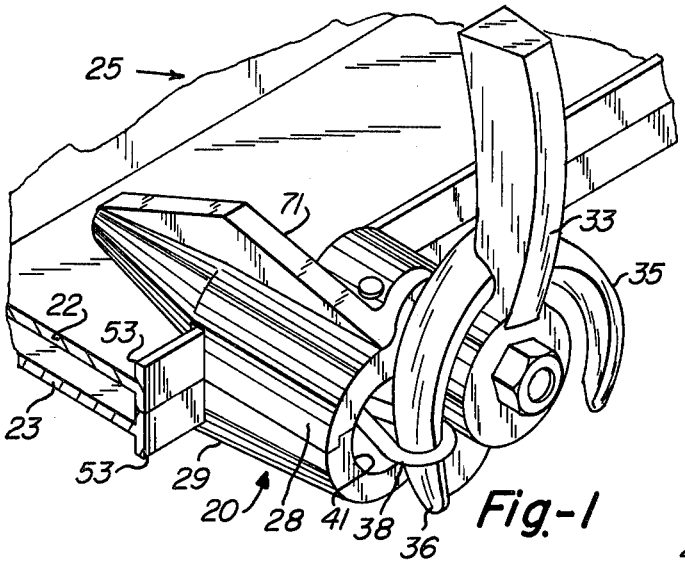
FIG. 1 is a view in perspective of a portion of a concrete casting form including rails of a pair of panels of one wall of the form with an embodiment of the clamping lock of the present invention secured to the rails and the anchor lock of the clamping lock engaging a loop of a looped tie.
Figure 2:
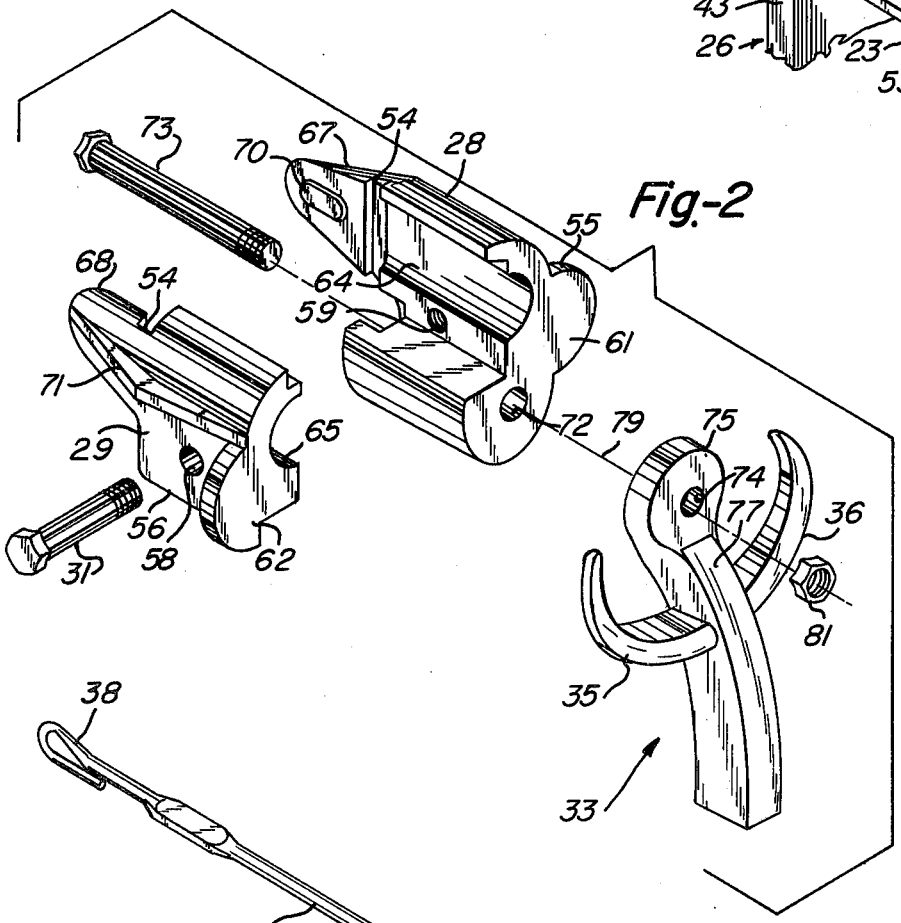
FIG. 2 is an exploded view of the clamping lock illustrated in FIG. 1.
Figure 3:
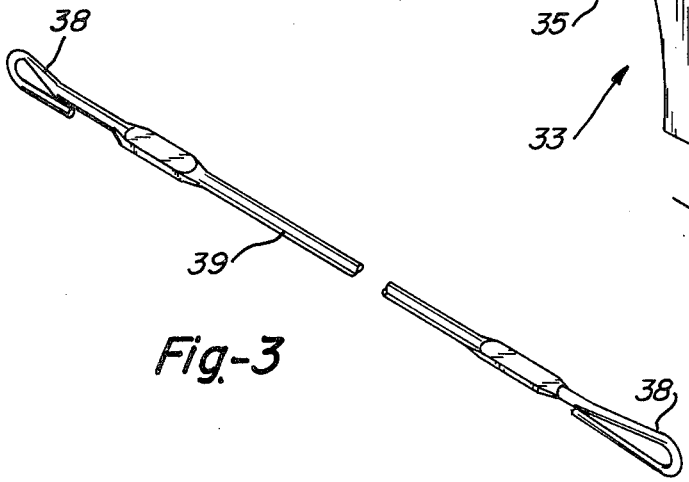
FIG. 3 is a view in perspective of a looped tie rod.
Figure 10:
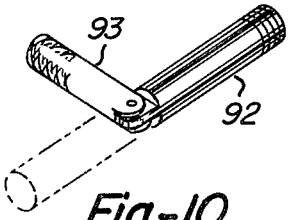
Figure 7:
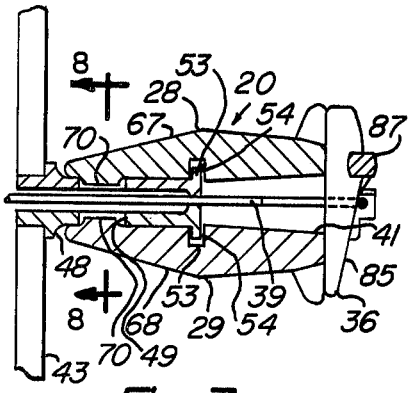
FIG. 7 is a section taken on line 7—7 of FIG. 5.
Figure 6:
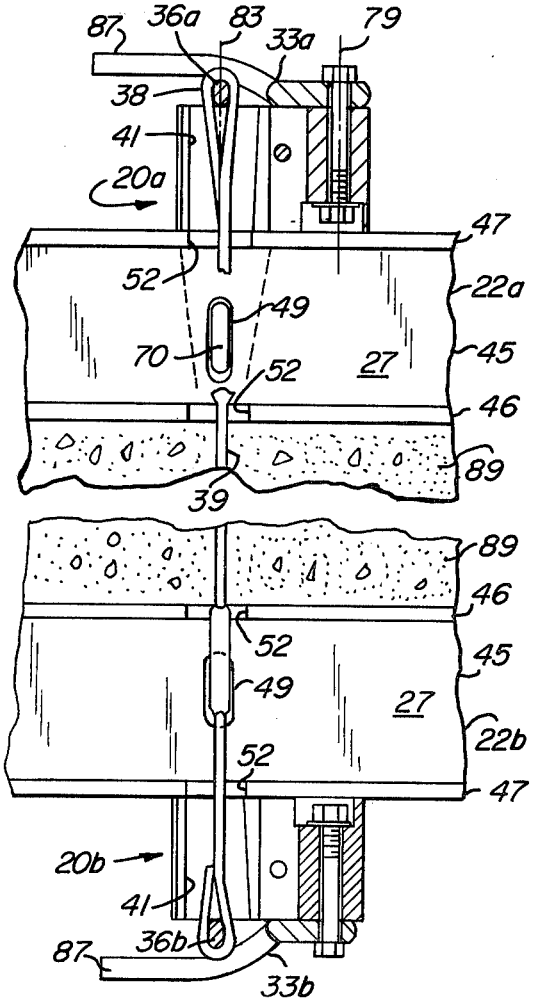
FIG. 6 is a section taken on line 6—6 of FIG. 5.

In FIG. 1 clamping lock 20 is illustrated as being secured, or clamped, to the rails 22, 23 of steel framed panels 25, 26. A plurality of such forms are interconnected to form the opposing walls of form 27, a fragmentary portion of which is illustrated in FIG. 6. Lock 20 has two clamping members 28, 29, which are secured or bolted together by bolt 31 which is illustrated in FIG. 2 to secure lock 20 to rails 22, 23 and to position lock 20 properly on rails 22, 23 as will be explained subsequently. Tie fastening means, or anchor lock 33, is pivotally mounted on clamping member 28. Anchor lock 33 has a pair of arms 35, 36, either of which is adapted to be inserted into a loop 38 of looped tie 39, which is illustrated in FIG. 3. It should be noted that a part, or portion of loop 38 extends, or protrudes beyond, opening 41 formed by clamping members 28, 29 when they are secured together as illustrated in FIGS. 1, 6 and 7 which facilitates breaking off, or breaking back, of the ties without first removing the panels after the concrete has set.

Figure 4:
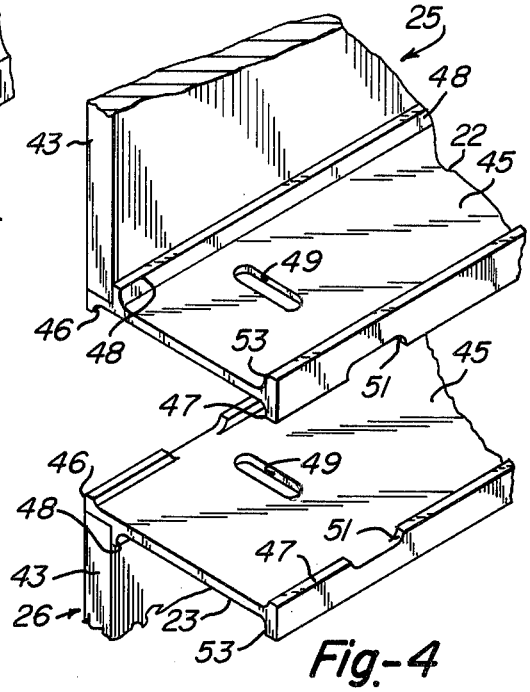
FIG. 4 is a view in perspective of portions of a pair of steel framed panels.
Figure 8:
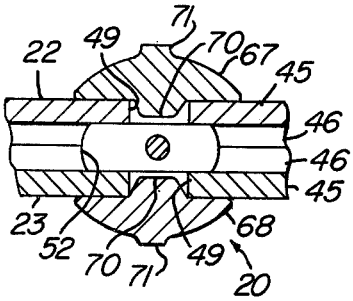
FIG. 8 is a section taken on line 8—8 of FIG. 7.

In FIG. 4 details of steel framed panels 25, 26 are illustrated, particularly those which facilitate clamping or securing lock 20 to the rails 22, 23 of panels 25, 26 so that tie fastening means 33 can fasten or lock one end of looped tie 39 to rails 22, 23. Facing 43 of panels 25, 26 in a preferred embodiment is made of plywood. Rails 22, 23 each has a web portion 45 and a pair of contact flanges 46, 47 which project from the same side of the web outwardly from the panel to which the rail is secured. An attachment flange 48 is provided on the other side of web 45 to facilitate fastening the rails 22, 23 to the facing 43. Connector slots 49 are formed in the webs 45. They are of uniform dimensions and are evenly, or uniformly, spaced along the rails so that when two panels are positioned side by side and are aligned properly corresponding connector slots 49 are aligned and opposite one another. Tie notches 51 are formed in the contact flanges 46, 47. When the rails 22, 23 are positioned side by side, so that they are properly aligned with contact flanges 46, 47 in substantial contact, notches 51 substantially form a rectangular tie slot 52 which is best illustrated in FIGS. 6 and 8. An additional flange 53 which projects from the same side of webs 45 as attachment flange 48 is provided on some commercially available panels. These flanges 53 when present provide additional stiffness and strength to the rails and to the panels. Clamping members 28, 29 are provided with grooves 54 within the flanges 53 readily fit as is best seen in FIG. 7.

Clamping members 28, 29 of lock 20 as seen in FIG. 2 each has a base 55, 56 which bases are provided with cooperating substantially planar surfaces. When members 28, 29 are secured or forced together by tightening bolt 31, for example, which extends through bore 58 in base 56 and is threaded into threaded bore 59 formed in base 55, members 28, 29 form a unitary structure. Bolt 31 and bores 58, 59 are the means for removably securing together clamping members 28, 29 in the embodiment illustrated in FIG. 2. Bases 55, 56 are also provided with substantially planar bearing surfaces 61, 62 which are substantially coplanar when members 28, 29 are secured together by tightening bolt 31. In addition bases 55, 56 are provided with tie surfaces 64, 65 which cooperate when members 28, 29 are secured together as illustrated in FIG. 1 to form tie loop opening 41. Each clamping member 28, 29 is provided with a jaw 67, 68 which extends from bases 55, 56 respectively as is best illustrated in FIG. 2. Each of the inner surfaces of jaws 67, 68 is provided with a tooth, or protrusion, 70 which is adapted to fit into one of a pair of aligned opposing connector slots 49 as is illustrated in FIGS. 7 and 8. Protrusions 70 are preferably made so that they do not enter into the area between rails and thus will not interfere with the positioning of a tie 39 through tie slots 52 as can be seen in FIGS. 7 and 8. To provide additional stiffness and strength particularly to jaws 67, 68 each clamping member is provided, in the preferred embodiment, with a rib 71 formed as an integral portion of clamping members 28, 29.

A pivot bore 72 is formed through base 55 of member 28 and a pivot bolt 73 is inserted through bore 72 and pivot opening 74 formed in the pivot eye 75 of shank 77 of anchor lock 33. Curved arms 35, 36 are attached on either side of shank 77. Arms 35, 36 are made integral with shank 77 and are substantially symmetric with respect to arcs of a circle whose center coincides with the center of pivot opening 74 and lies in the pivot axis 79 which is also the axis of pivot bore 72 when anchor lock 33 is pivotally mounted on base 55 by bolt 73 and nut 81. Arms 35, 36 are wedge shaped, increasing in height, from their tips to where they are connected to shank 77 as is best illustrated in FIG. 7. Arms 35, 36 also gradually increase in width from their tips to the shank. The bottom surfaces of the pivot eye 75 and of arms 35, 36 are adapted to contact, or be supported by, bearing surfaces 61, 62 of members 28, 29 as can be seen in FIGS. 6 and 7, and preferably are substantially flat, or planar, so that anchor lock 33 can turn easily about the pivot axis 79. While anchor lock 33 is illustrated as having two arms in FIGS. 1 and 2, since only one arm is used at a time, one could be omitted.

Tie 39 which is illustrated in FIG. 3 is preferably made of steel rod, number 3 or number 4 gauge, with the ends welded to the body of the tie to form loops 38 at both ends. The dimensions of tie 39 are chosen so that the loops 38 will fit easily within the tie slots 52 of the rails 22, 23 of adjoining panels and so that a portion of loops 38 will project beyond bearing surfaces 61, 62 of members 28, 29 when locks 20*a*, 20*b* are properly clamped to the rails of panels of opposing walls of form 27 as illustrated in FIG. 6. This facilitates the entry of one of the tapered arms of anchor lock 33, such as arm 36, into loop 38 as illustrated in FIG. 1.

To make it easier to position ties 39 between pairs of rails of panels making up opposite walls of form 27 and to break it back, tie opening 41 of lock 20 is shaped so that it has a circular cross section where it intersects bearing surfaces 61, 62 of members 28, 29. Tie opening 41 has a rectangular cross section at its other end. The size of the rectangular area of tie opening 41 is substantially equal to that of a tie slot 52. The rectangular shape of the tie opening 41 in proximity to the nearest tie opening 52 helps to align a tie 39 with tie slots 52 in the rails of the panels used to construct a form, and thus to permit ties to be quickly and efficiently positioned in a form.

Figure 5:
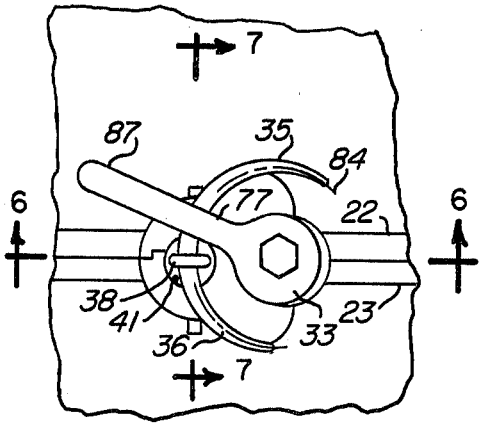
FIG. 5 is a plan view of the clamping lock of FIG. 1.

The relationship between the curved arms 35, 36 of anchor lock 33, pivot axis 79 and the symmetrical axis 83 of tie opening 41 are best explained by references to FIGS. 5 and 6. The arms 35, 36 are substantially symmetric to an arc 84 of a circle whose center lies on pivot axis 79 of FIG. 6. Arc 84 also substantially intersects the axis of symmetry 83 of tie opening 41 formed in lock 20*a*. As a result, it is relatively easy to insert either arm 36 or arm 35 into loop 38 of tie 39 to lock, or fasten, loop 38 to lock 20*a* as is illustrated in FIG. 6. The slope of the upper surfaces such as surface 85 of arm 36 as illustrated in FIG. 7 permits a workman who is erecting a form to apply significant tension to tie 39 by applying force to arm 87 of anchor lock 33 which is an extension of shank 77.

The interaction of the teeth or protrusions 70 with connector slots 49 properly position clamping lock 20 on rails 22, 23 as is best illustrated in FIGS. 6, 7 and 8. Each tooth, or protrusion, 70 is tapered slightly to fit readily into slots 49 and as the jaws 67, 68 of a lock 20 which is astride the rails as seen in FIG. 7 are tightened by tightening bolt 31, each clamping lock 20 is positioned so that its tie opening 41 is aligned with tie slots 52 as seen in FIGS. 6 and 7 and is securely fastened to the rails. Protrusions 70 do not extend into the interior of the space between rails 22, 23, or stated another way, their height does not exceed the thickness of web 45 as can be seen in FIGS. 7 and 8.

In FIG. 6 a portion of form structure 27 made up of interconnected, or ganged, panels is illustrated. Rails 22*a*, 22*b* are connected by tie 39 which extends between a pair of clamping locks 20*a*, 20*b* which are secured to the rails 22*a*, 22*b*. Tie 39 extends from the anchor lock 33*a* of clamping lock 20*a* to anchor lock 33*b* of clamping lock 20*b*. To confine semi-liquid concrete 89 within form 27 the pressure of the concrete against the facings 43 of the panels is transmitted to the ties 39 between opposing walls of form 27 through the arms of the clamping locks, such as arms 36*a*, 36*b* of locks 20*a*, 20*b* as illustrated in FIG. 6.

The stiffness of tie 39 and the relatively close fit between the loop 38 of a tie and the thickest portion of either of the arms 35, 36 of anchor lock 33 resist any tendency of opposing walls of form 27 to move toward one another prior to concrete being poured into form 27 and thus act as spreaders or spacers which properly hold the opposing walls of the form 27 apart the prescribed distance until concrete is poured into the form.

Figure 9:
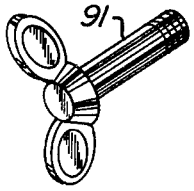
FIGS. 9, 10, 11, 12 and 13 illustrate various modifications of the means for securing the clamping members of the clamping lock together.

Alternate ways for forcing or clamping members 28, 29 of clamping lock 20 together are illustrated in FIGS. 9, 10, 11, 12 and 13. In the preferred embodiment illustrated in FIGS. 1 and 2 a hexagonal headed bolt 31 is the means for securing the clamping members 28, 29 of clamping lock 20 together. A winged bolt 91 which is illustrated in FIG. 9 or a swing arm bolt 92 with an arm 93 pivotally secured to one end of bolt 92 can be substituted for hex headed bolt 31. An advantage of such a substitution is that winged bolt 91 or swing arm bolt 92 can be tightened or loosened by hand whereas a conventional wrench is needed to tighten or loosen bolt 31.

Figure 11:
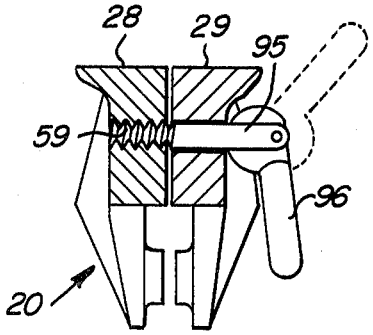

In the modification of FIG. 11 a pin 95 is threaded into bore 59 of jaw 28. Cam arm 96 is pivotally mounted on pin 95. As arm 96 is rotated from its unlocked position, the position shown in dotted lines in FIG. 11, to its locked position illustrated in full lines, jaws 28 and 29 are forced together and held together until arm 96 is returned to its unlocked position. In the embodiment illustrated in FIG. 12, bore 98 in clamping member 29 is tapered to permit jaw 68 to swing away from jaw 67. This allows the jaws 67, 68 to be placed astride the rails to which they are to be clamped by loosening bolt 31.

Figure 13:
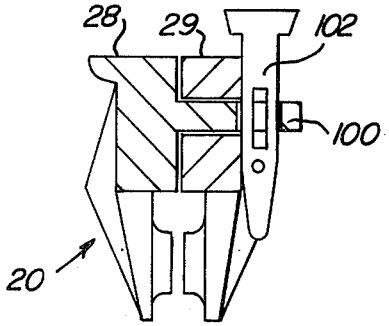
Figure 14:
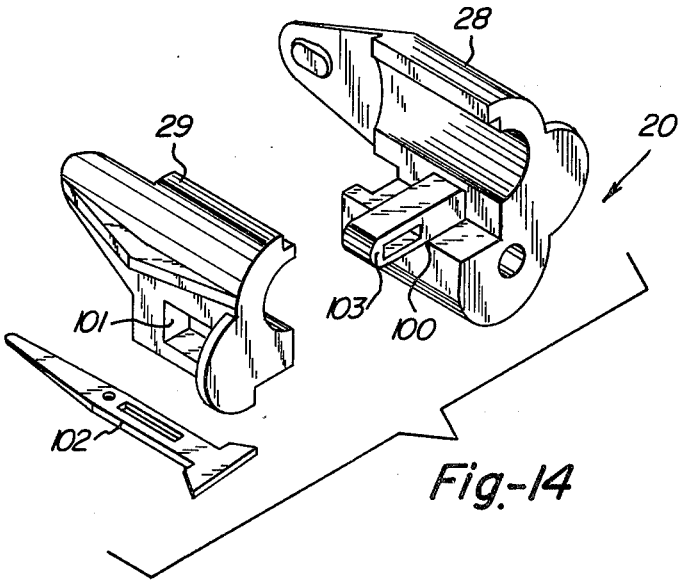
FIG. 14 is an exploded view of the modifications illustrated in FIG. 13.

In FIG. 13 another modification of the means of removably securing together clamping member 28, 29 of clamping lock 20 is illustrated. A tongue 100 is formed as an integral part of member 28. A tongue receiving slot 101 is formed in jaw 29. When jaws 28 and 29 are assembled as illustrated in FIG. 13 they can be secured together by driving a wedge key 102 into key slot 103 formed in tongue 100. In the modification of the securing means illustrated in FIGS. 11, 12 and 13 anchor lock 33 which is normally secured to clamping member 28 has been omitted to simplify the drawings.

Figure 15:
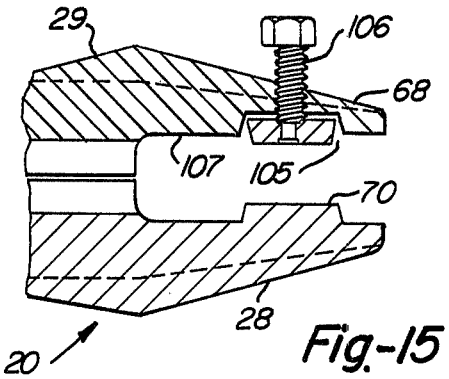
FIGS. 15 and 16 are illustrations of modifications of the protuberance or teeth of one of the clamping members.
Figure 12:
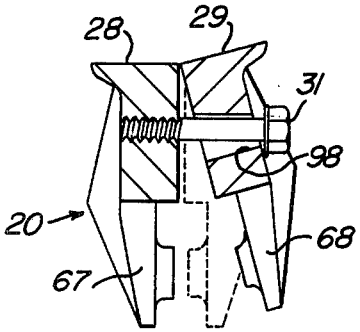
Figure 16:
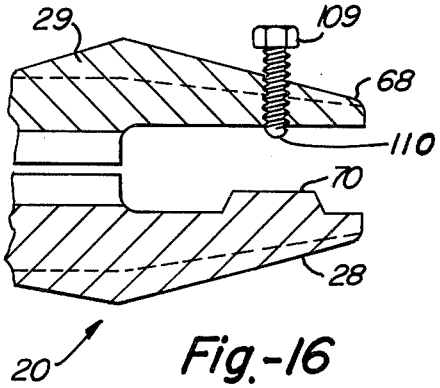

To provide clamping lock 20 with the capability of being used with rails which have been distorted in use, for example, an adjustable tooth or protrusion 105 can be attached to set screw 106 as is illustrated in FIG. 15. Face 105 is journaled on set screw 106 so that it does not rotate as set screw 106 is rotated to adjust the amount that tooth 105 projects beyond the inner surface 107 of jaw 68. In FIG. 16 cap screw 109 which is threaded into jaw 68 is provided with a rounded end 110 which serves as an adjustable tooth, or protuberance.

Figure 17:
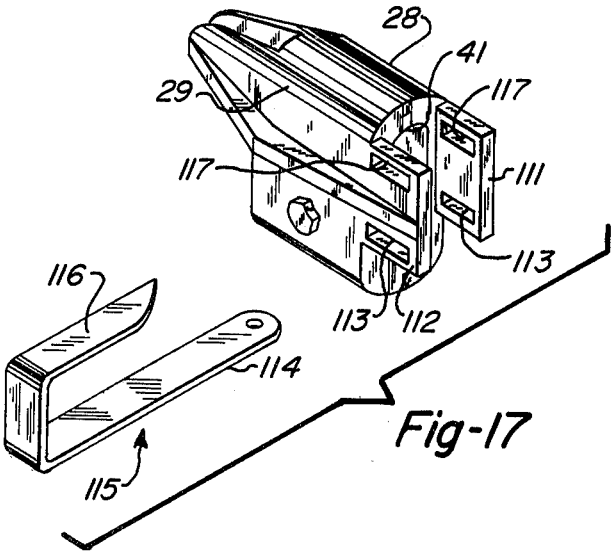
FIGS. 17, 18 and 19 illustrate modifications of the means for fastening the loop of a tie to the clamping lock of the invention.

In FIG. 17 another embodiment of the tie fastening means to secure the loop of a tie 39 to a clamping lock is illustrated. Clamping member 28 is provided with tang 111 and member 29 with tang 112. Each tang is provided with a guide slot 113 through which the handle 114 of lock pin 115 is adapted to be inserted. The wedge portion 116 of lock pin 115 is adapted to fit in wedge guide slots 117 which are formed in tangs 111 and 112. The wedge guide slots 117 are substantially aligned with the center of the tie opening 41 of clamping lock 20. By sliding handle 114 of lock pin 115 into the guide slots 113 and wedge portion 116 into wedge guide slots 117 of tangs 111, 112, the wedge portion 116 can be inserted into a loop 38 of a tie 39 which is not illustrated to secure loop 38 to clamping lock 20.

Figure 18:
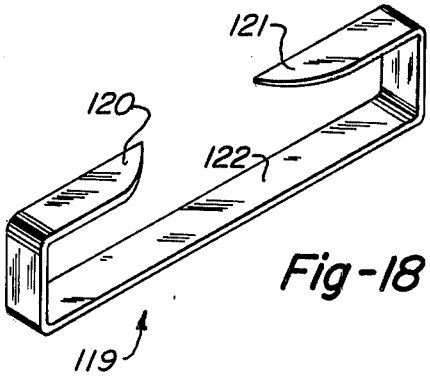

In FIG. 18 a modified form of lock pin 119 is illustrated. Lock pin 119 is provided with a pair of wedge portions 120, 121 which are secured at opposite ends of handle 122. Lock pins 119 permit either wedge portion 120 or wedge portion 121 to be used to attach a tie 39 to a clamping lock.

Figure 19:
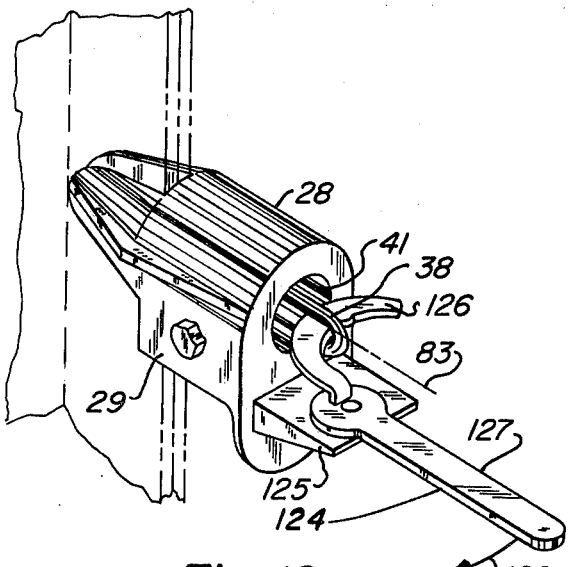

In FIG. 19 cam lock 124 is pivotally mounted on tang 125 which is formed integrally with clamping member 28. Arm 126 of cam lock 124 is curved to apply tension to loop 38 of tie 39 through which arm 126 is forced as lever 127 is rotated in the direction of arrow 128. When cam lock 124 is rotated to a position to fully tension tie 39, its locked position, the geometry of the cam lock 124 and the forces applied to it is such that these forces will maintain cam lock 124 in its locked position until an additional force is applied in the opposite direction of arrow 128 to lever 127. Arm 126 is offset so that it passes substantially through the axis of symmetry 83 of tie opening 41.

Figure 20:
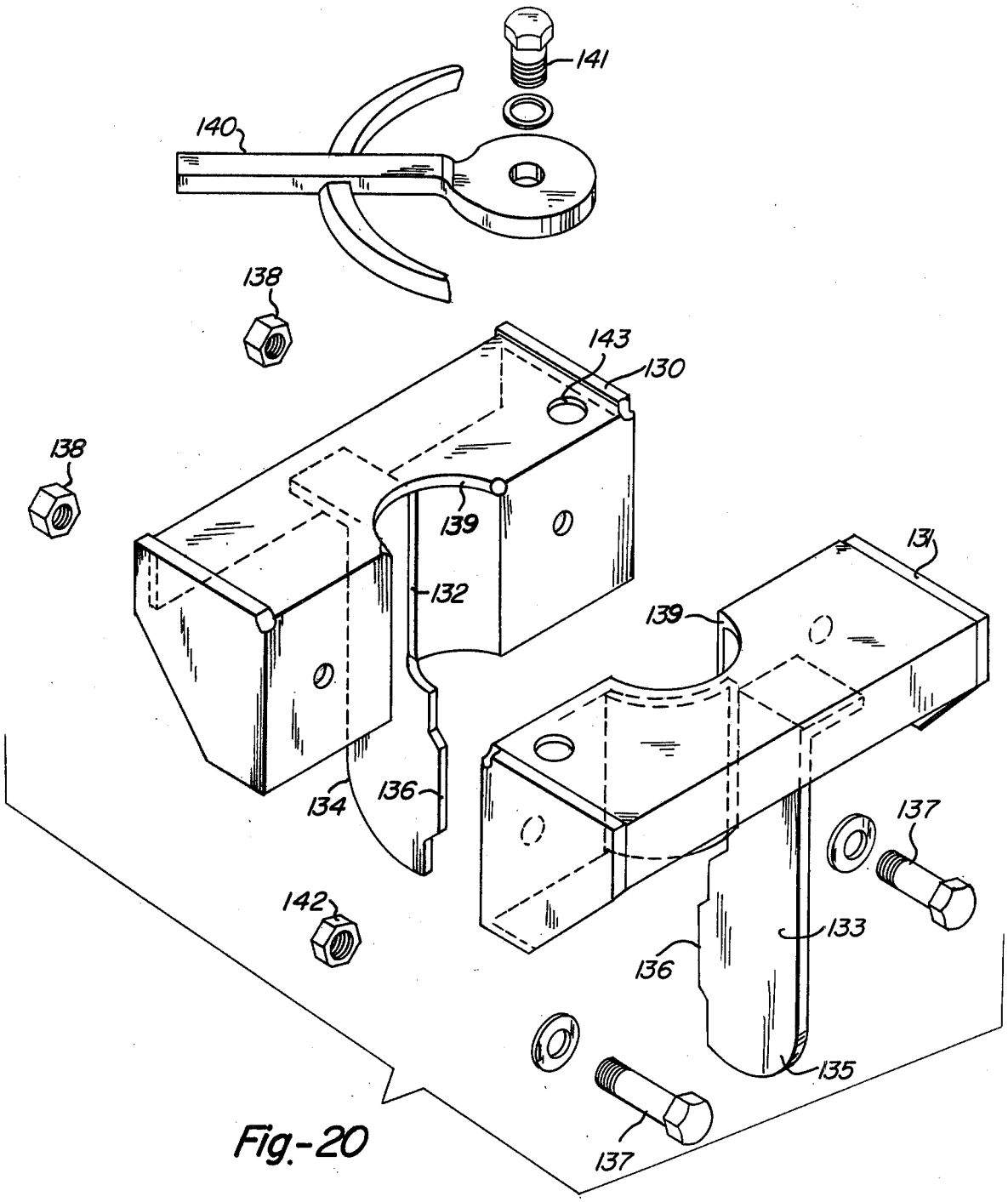
FIG. 20 is an illustration of a modification of the clamping lock which is adapted to be fabricated from steel stampings.

In the various modifications of the embodiments of the clamping lock described heretofore, the clamping members have been made of a suitable cast metal such as a moldable cast iron, steel or aluminum. However, clamping members 130, 131 of the embodiment illustrated in FIG. 20 are made from stamped or pressed metal such as steel. Each member 130, 131 has a base 132, 133 and each base has a jaw 134, 135 depending from its base. Each jaw is provided with a protrusion, or tooth, 136 adapted to fit into the connector slots 49 of rails 22, 23 which are not illustrated in FIG. 20. The two members 130, 131 are secured together by a pair of bolts 137 onto which nuts 138 are threaded. A tie opening, or passage, 139 is formed by surfaces of members 130, 131, 132 and 133 in a manner similar to that of other embodiments of the clamping cam lock of this invention. Anchor lock 140 is pivotally mounted on member 130 by bolt 141 and nut 142 which are positioned through pivot bore 143.

Figure 21:
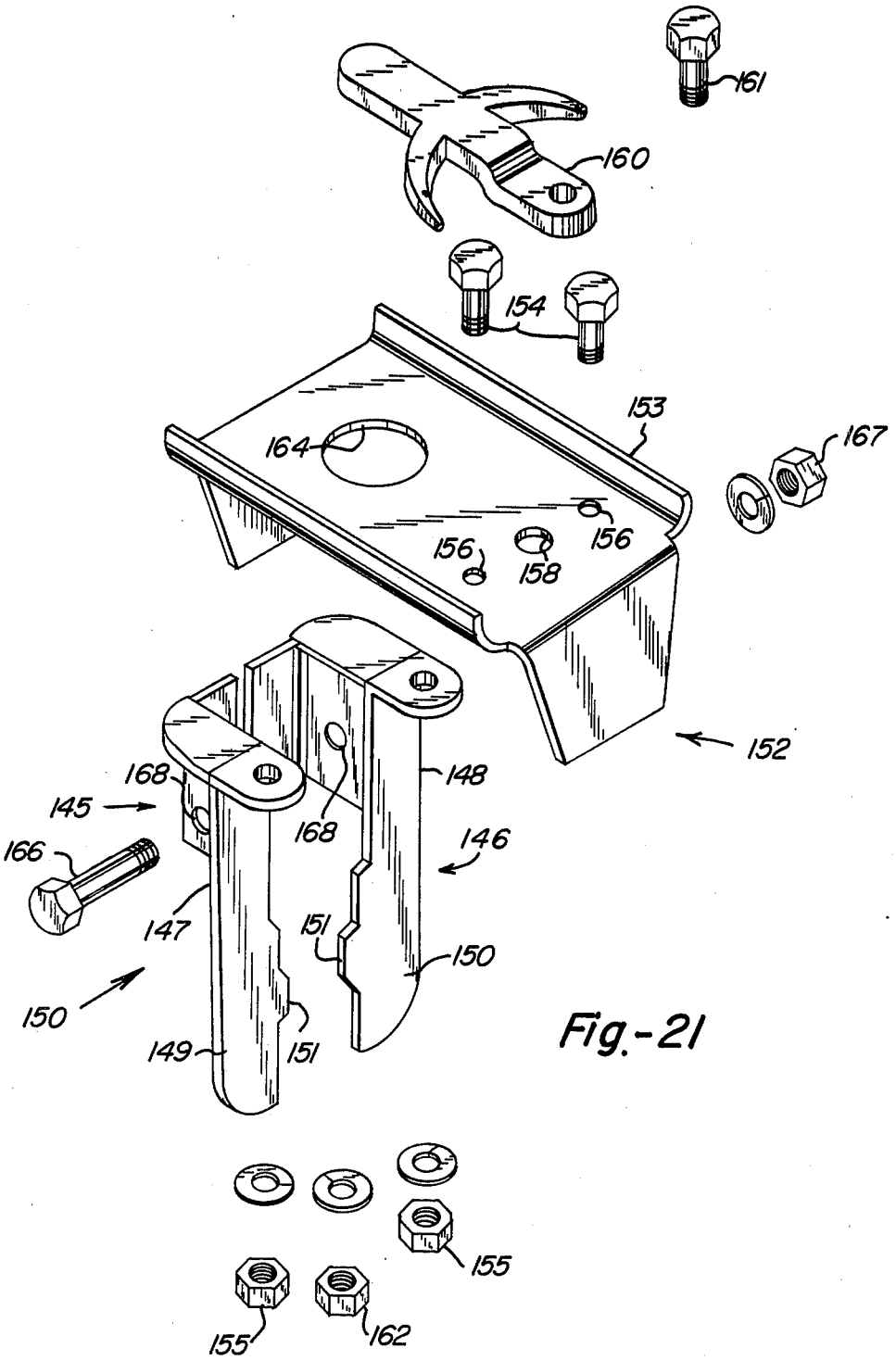
FIG. 21 is a second modification of the clamping lock of the invention which is also adapted to be fabricated from metal stampings.

In FIG. 21 another embodiment of the clamping lock of this invention is disclosed which is also adapted to be made from metal stampings. Clamping members 145, 146 have bases 147, 148 with depending integral jaws 149, 150. Each of the jaws 149, 150 is provided with protrusion, or tooth, 151 which is adapted to fit into connector slots 49 of rails 22, 23 which are not illustrated in FIG. 21 to properly position and secure clamping lock 152 to such rails. Bases 147, 148 are pivotally secured to base plate 153 by bolts 154 and nuts 155 which are inserted through openings, or holes, 156. A pivot bore 158 is formed through plate 153 to which anchor lock 160 is pivotally secured by bolt 161 and nut 162. A circular opening 164 in base plate 153 and portions of bases 147, 148 form a passage through which a loop 38 of a tie 39 that is not illustrated can be extended and engaged by an arm of anchor lock 160 to properly secure the loop to the clamping lock 152. Clamping members 145, 146 are secured together by bolt 166 and nut 167. Bolt 166 is adapted to be inserted through bores 168 in members 145, 146.

An alternative embodiment is shown in FIGS. 22–24 wherein a locking clamp 170 is secured or clamped to rails 22', 23' of steel framed panels, such as panel 25'. Lock 170 has two clamping members 172, 173 which are pivoted together by pivot pin 174 which extends through openings 175 and 176 in ears 177 and 178, respectively, of clamping member 172 as best seen in FIG. 23. Conveniently, clamping member 173 has an aperture 179 in ear 180. This ear 180 fits between ears 177 and 178, respectively, so that the aperture 179 aligns with apertures 175 and 176 for receiving bolt 174. Advantageously, a tie fasting means in the form of anchor lock 182 includes a pivot eye 183 having a pivot opening 184 for receiving the end of bolt 174, the latter being held in place by means of a nut 185.

Clamping members 172 and 173 each include wall means defining tie surfaces 186 and 187 which when pivoted together in clamping engagement as shown in FIG. 22, form a tie loop opening 188 for receiving a loop 38' of a tie. Conveniently, jaws 190 and 191 extend from clamping members 172 and 173, respectively, and are each provided with a tooth or protrusion 192, 193 for engagement with slots in rails 22' and 23' which correspond to slots 49, shown in FIG. 4.

Advantageously, the clamping members are held together by means of a swing bolt 195 which is connected to a yoke comprising spaced ears 196 and 197 on the opposite side of clamping member 172 from ears 177 and 178. The bolt is provided with an aperture 198 adjacent one end thereof for receiving a pivot pin 199 which extends through apertures 200 and 201 in ears 196 and 197, respectively. The pivot pin may be swung to a closed position wherein it extends between a pair of spaced fingers 202 and 203 on clamping member 173 on a side opposite that of ear 180. Conveniently, a nut 204 is threadably received on the opposite end of swing bolt 195 and has a washer 205 welded thereto which bears against fingers 202 and 203 as best seen in FIGS. 22 and 24 when nut 204 is tightened down on swing bolt 195 to hold the clamping members in clamped position.

When the clamping members are in the clamped position, anchor lock 182 may be swung so that one or the other of its arcuate arms 206 or 207 may be swung through loop 38' of a form tie to hold it in place. Conveniently, the anchor lock is normally swung to the position where gravity assists in holding it in locked position. It will be understood that nut 204 may be made separately from washer 205, if desired. As in the previous embodiments, the clamping lock of FIGS. 23–24 may be provided with reinforcing ribs 208 and 209, respectively.

Between the respective jaws and the tie surface of each clamping member are grooves or notches 210 and 211, respectively, fit around the additional flanges 53' on rails 22' and 23', respectively, as seen in FIG. 22.

An advantage of the locking clamp of FIGS. 22–24 is that the clamping members are connected together as a unit, being pivoted about pivot pin 174 which also serves as a pivot for anchor lock 182. Furthermore, a greater mechanical advantage is obtained in clamping since the swing bolt is on the side from tie bolt opening 188 opposite pivot pin 174 so that substantial pressure can be applied to the clamping hands to lock them in position on the rails.

It should be evident that various modifications can be made to the described embodiments without departing from the scope of the present invention.

I claim:

1. In a form having opposing walls, each of the walls being composed of a plurality of adjacent panels, each panel having a facing, rails attached to the perimeter of each facing, each rail having a web and a pair of contact flanges which project outwardly from each panel, tie notches formed in the contact flanges, the positions of the tie notches being such that when two panels are placed side by side with the contact flanges of rails of adjacent panels substantially in contact, the tie notches of the rails substantially form pairs of tie slots; a looped tie extending through the aligned tie slots of pairs of panels of opposing walls of the form with the looped ends of the tie projecting through the rails of adjacent panels of the opposing walls, a clamping lock for securing a loop of a tie to the rails of a pair of adjacent panels of a wall of the form; the improvement in the clamping lock comprising:

a pair of clamping members mountable astride said rails;

means for removably securing said clamping members together;

means forming a looped tie opening between the clamping members, said opening being substantially aligned with the centers of the tie slots; and means attached to one of said clamping members for fixedly securing the loop of a tie to the clamping lock.

2. The invention of claim 1 wherein:

each clamping member has a base, a jaw depending from said base, and a rib for stiffening and strengthening each member; and the base, jaw and rib of each member are formed integrally.

3. The invention of claim 1 wherein:

the clamping members are fabricated from sheet metal.

4. The invention of claim 3 wherein:

the clamping members are pivotally mounted on a base plate.

5. The invention of claim 1 wherein the means for removably securing the clamping members together comprises:

a bolt extending through a bore in one member which bolt is threaded into a threaded bore in the other member.

6. The invention of claim 5 wherein:

the bore in the members through which the bolt extends is tapered so that the clamping members can be swung apart without removing the bolt from the threaded bore to place the members astride a pair of rails of adjacent panels.

7. The invention of claim 5 wherein:

the bolt is a winged bolt.

8. The invention of claim 5 wherein: the bolt is a swing arm bolt.

9. The invention of claim 1 wherein:

the means for removably securing the clamping members together is a cam arm pivotally mounted on a pin, said pin extending through a bore in one member and being threaded into a threaded bore in the other member.

10. The invention of claim 1 wherein the means for securing the clamping members together comprises:

a tongue formed integrally with one of the clamping members;

a tongue slot formed in the other clamping member;

a key slot formed in the tongue; and a key wedge drivable into the key slot to secure the clamping members together.

11. The invention of claim 1 wherein the means for fixedly securing the loop of a tie to the clamping lock comprises:

an anchor lock having a shank;

a curved tapered arm attached to the shank; and means pivotally mounting the shank on one of said clamping members so that said arm can be inserted into the loop of a tie to secure the loop to the clamping lock.

12. The invention of claim 1 wherein the means for fixedly securing the loop of a tie to the clamping lock comprises:

a first tang formed integrally with one clamping member and a second tang formed integrally with the other member;

guide slots formed in each of the tangs;

wedge guide slots formed in each of the tangs; and a lock pin including:

a handle;

a wedge portion connected to the handle, the handle of the lock pin being insertable into the guide slots and the wedge portion being insertable into the wedge guide slots of the tangs and the loop of a tie.

13. The invention of claim 12 wherein:

said lock pin has a wedge portion attached to each end of said handle.

14. The invention of claim 1 wherein:

said means for fixedly securing the loop of the tie to said clamping lock comprises:

a cam lock pivotally mounted on a tang made integrally with one of said clamping members and having an offset curved arm which can be forced into the loop of a tie opening formed between said clamping members.

15. The invention of claim 1 wherein:

connector slots are formed in the webs and positioned so that when two panels are placed side by side with the contact flanges of rails of adjacent panels substantially in contact, opposing pairs of connector slots in the rails are aligned; the relationship between associated tie slots and connector slots being such that lines passing through the centers of the connector slots and tie slots substantially intersect, the improvement further comprising:

protrusion means formed on each of said members, said protrusion means being insertable into a pair of opposing connector slots in the rails between said clamping members.

16. The invention of claim 15 wherein:

the protrusion means on one of said clamping members is a set screw threaded through the member with a tooth pivotally secured to the set screw.

17. The invention of claim 15 wherein:

the protrusion means of at least one of the clamping members is a cap screw.

18. The invention of claim 1 wherein the means for removably securing the clamping members together comprises:

means on one side of said looped tie opening pivotally interconnecting said clamping members;

a swing bolt pivotally attached to one of said clamping members on the opposite side of said looped tie opening; and means on said other clamping member engagable by said swing bolt to secure said clamping members together.

19. The invention of claim 18 further including:

a yoke on said opposite side of said looped tie opening of said one of said clamping members to which said swing bolt is pivoted;

a pair of spaced fingers on said opposite side of said looped tie opening of said other clamping member for receiving said swing bolt therebetween; and adjustable means on said swing bolt engagable with said fingers to hold said clamping members together.

20. The invention of claim 19 wherein said adjustable means includes:

a nut threadably received on said swing bolt; and flange means on said swing bolt movable into gripping engagement with said fingers by adjusting said nut to hold said clamping members together.

21. In a form for settable casting compositions having first and second opposing walls; each of said walls being comprised of a plurality of interconnected panels; said panels having substantially rectangular facings; metal rails attached to the perimeters of the facings; said rails having a pair of contact flanges and a web between the flanges; tie notches formed in the contact flanges of the rails; said tie notches being uniformly spaced so that when a pair of adjacent panels are interconnected to form a first wall of the form, the contact flanges of the rails on adjacent sides of the panels substantially are in contact with one another, the adjacent tie notches substantially form tie slots; the panels forming the second wall of the form being positioned so that pairs of tie slots formed by the rails of adjacent panels are substantially aligned with corresponding pairs of tie slots of the first wall; and a looped tie having loops at each end positioned within the aligned tie slots with the loops of the tie extending beyond the ends of the rails, a clamping lock engaging the loops of the tie; the improvement in the clamping lock comprising in combination:

a pair of clamping members, each member having a base and a jaw depending from each base, said clamping members being securable together and mounted astride a pair of rails of adjacent panels of a wall of the form with the rails between the jaws of the members;

wall means on said bases for forming a tie loop passage having an axis of symmetry when the clamping means are secured together;

means on said bases for removably securing said bases of the clamping members together to secure the clamping lock to the rails, to clamp the rails together, and to position the clamping lock so that the longitudinal axis of the tie loop passage is substantially aligned with the tie notches of the rails between the jaws; and tie fastening means having a tapered arm mounted on said members, said tapered arm being insertable in the loop of a tie extending beyond the tie loop passage to secure the loop to the members.

22. The invention of claim 21 wherein the tie fastening means comprises:

a shank pivotally mounted about a pivot axis on one of said clamping members, the tapered arm being secured to said shank, said tapered arm lying on an arc of a circle whose center lies on the pivot axis and which arc substantially intersects the longitudinal axis of the tie loop passage.

23. The invention of claim 22 wherein:

a pair of tapered arms are secured to the shank.

24. The invention of claim 21 wherein:

each clamping member has a stiffening rib integral with its base and jaw.

25. The invention of claim 21 wherein:

connector slots are formed in the webs and positioned so that when two panels are placed side by side with the contact flanges of rails of adjacent panels substantially in contact, opposing pairs of connector slots in the rails are aligned; the relationship between associated tie slots and connector slots being such that lines passing through the centers of the connector slots and tie slots substantially intersect, the improvement further comprising:

protrusion means formed on each of said members, said protrusion means being insertable into a pair of opposing connector slots in the rails between said clamping members.

26. The invention of claim 25 wherein:

the protrusion means on one of said clamping members is a set screw threaded through the member with a tooth pivotally secured to the set screw.

27. The invention of claim 25 wherein:

the protrusion means of at least one of the clamping members is a cap screw.

28. The invention of claim 21 wherein the means for removably securing the clamping members together comprises:

means on one side of said looped tie opening pivotally interconnecting said clamping members;

a swing bolt pivotally attached to one of said clamping members on the opposite side of said looped tie opening; and means on said other clamping member engagable by said swing bolt to secure said clamping members together.

29. The invention of claim 28 further including:

a yoke on said opposite side of said looped tie opening of said one of said clamping members to which said swing bolt is pivoted;

a pair of spaced fingers on said opposite side of said looped tie opening of said other clamping member for receiving said swing bolt therebetween; and adjustable means on said swing bolt engagable with said fingers to hold said clamping members together.

30. The invention of claim 29 wherein said adjustable means includes:

a nut threadably received on said swing bolt; and flange means on said swing bolt movable into gripping engagement with said fingers by adjusting said nut to hold said clamping members together.

31. A clamping lock for securing a loop of a looped tie to a wall of a settable casting composition form having opposing walls, a plurality of panels being interconnected to form a wall of sid form, said panels having rails attached to their perimeters, the rails of said panels having pairs of contact flanges and a web, tie notches formed in the contact flanges through which a looped tie may extend, said clamping lock comprising:

a pair of clamping members, each member having a base having wall means, the wall means of said base forming a tie loop opening when the bases are secured together;

a jaw depending from each base;

means on said bases for removably securing said bases of the clamping members together, said clamping members positionable on a pair of rails of adjacent panels so that the rails are between the jaws, the tie notches in the contact flanges form a pair of tie slots, and the clamping lock is positioned on the rails so that its tie opening is substantially aligned with the tie slots in the rails between its jaws; and tie fastening means pivotally mounted about a pivot axis on the base of one of said members, said fastening means having a curved tapered arm which is insertable into the loop of the looped tie protruding beyond the tie loop opening to secure the loop to the clamping lock.

32. The clamping lock of claim 31 wherein said tie loop opening has a longitudinal axis which is adapted to be substantially in alignment with the centers of the tie slots.

33. The clamping lock of claim 32 wherein:

the cross-sectional area of said tie loop opening nearest a tie slot is substantially rectangular and of substantially the same area as that of a tie slot and at its other end is substantially circular.

34. The clamping lock of claim 33 wherein:

said curved tapered arm of said tie fastening means lies on an arc of a circle whose center lies on said pivot axis and which substantially intersects the longitudinal axis of said tie loop opening.

35. The clamping lock of claim 34 wherein:

said fastening means is provided with a pair of curved tapered arms.

36. The clamping lock of claim 31 wherein the means for removably securing the clamping members together comprises:

a bolt extending through a bore in one member which bolt is threaded into a threaded bore in the other member.

37. The clamping lock of claim 36 wherein:

connector slots are formed in the webs and positioned so that when two panels are placed side by side with the contact flanges of rails of adjacent panels substantially in contact, opposing pairs of connector slots in the rails are aligned; the relationship between associated tie slots and connector slots being such that lines passing through the centers of the connector slots and tie slots substantially intersect, and protrusion means formed on each of said members, said protrusion means being insertable into a pair of opposing connector slots in the rails between said clamping members, the protrusion means on one of said clamping members is a set screw threaded through the member with a tooth pivotally secured to the set screw.

38. The clamping lock of claim 36 wherein:

connector slots are formed in the webs and positioned so that when two panels are placed side by side with the contact flanges of rails of adjacent panels substantially in contact, opposing pairs of connector slots in the rails are aligned; the relationship between associated tie slots and connector slots being such that lines passing through the centers of the connector slots and tie slots substantially intersect, and protrusion means formed on each of said members, said protrusion means being insertable into a pair of opposing connector slots in the rails between said clamping members, the protrusion means of at least one of the clamping members is a cap screw.

39. The clamping lock of claim 31 wherein the means for removably securing the clamping members together comprises:

means on one side of said looped tie opening pivotally interconnecting said clamping members;

a swing bolt pivotally attached to one of said clamping members on the opposite side of said looped tie opening; and means on said other clamping member engagable by said swing bolt to secure said clamping members together.

40. The clamping lock of claim 39 further including:

a yoke on said opposite side of said looped tie opening of said one of said clamping members to which said swing bolt is pivoted;

a pair of spaced fingers on said opposite side of said looped tie opening of said other clamping member for receiving said swing bolt therebetween; and adjustable means on said swing bolt engagable with said fingers to hold said clamping members together.

41. The clamping lock of claim 40 wherein said adjustable means includes:

a nut threadably received on said swing bolt; and flange means on said swing bolt movable into gripping engagement with said fingers by adjusting said nut to hold said clamping members together.

42. A clamping lock for securing a loop of a looped tie to a pair of panels of a wall of a settable casting composition form having opposing walls, said clamping lock comprising:

a pair of clamping members, each member having a base;

a jaw depending from each base;

a tooth formed on each jaw, each tooth adapted to be inserted into a connector slot of a rail of a panel of the form, said rail including a contact flange;

means on said bases for removably securing said bases of the clamping members together, said jaws of the clamping members adapted to be positioned astride a pair of rails of adjacent aligned panels so that the tooth of each jaw is inserted into one of a pair of opposed connector slots in the rails between the jaws of the members;

wall means on the bases of said members when secured together forming a tie opening having a longitudinal axis, which axis is adapted to be substantially aligned with the centers of a pair of tie slots formed when the contact flanges of a pair of rails of aligned panels are in substantial contact, and having this position when the teeth of the jaws are inserted into a pair of opposed connector slots of a pair of rails by securing the bases of the clamping members together;

bearing surfaces formed on the bases of the two members, said bearing surfaces when the members are secured together being substantially coplanar;

an anchor lock having a shank and a curved arm attached to the shank, the shank of said anchor lock being pivotally mounted on a bearing surface of a base of one member for rotation about a pivot axis, the arm of the anchor lock being wedge shaped and lying on an arc having its center on the pivot axis, the arc of the arm of the anchor lock substantially intersecting the longitudinal axis of the tie opening; whereby the arm of the anchor lock is adapted to be inserted into the loop of a looped tie extending through the tie slots aligned with the tie opening with at least a portion of the loop extending beyond the bearing surfaces of the bases of the clamping member.

43. In the clamping lock of claim 42 wherein:

said tie slots have a rectangular cross-section and the cross-sectional area of the tie opening adjacent the bearing surfaces is circular and the cross-sectional area of the tie opening proximate a tie slot is substantially rectangular and substantially equal in size to that of a tie slot.

44. In the clamping lock of claim 42 wherein:

said curved arm of the anchor lock has a substantially planar surface in contact with the bearing surfaces of the bases.

45. The clamping lock of claim 44 wherein:

said anchor lock is provided with a pair of curved arms.

46. The clamping lock of claim 42 wherein:

each clamping member is provided with a rib formed integrally with the base and jaw of each member and in which the tooth formed on each jaw is formed integrally with the jaw.

47. The clamping lock of claim 42 wherein:

said jaws are provided with a groove within which the additional flange of a rail fits when the clamping members are positioned astride a pair of rails of adjacent panels.

48. The clamping lock of claim 42 wherein the means for removably securing the clamping members together comprises:

means on one side of said looped tie opening pivotally interconnecting said clamping members;

a swing bolt pivotally attached to one of said clamping members on the opposite side of said looped tie opening; and means on said other clamping member engagable by said swing bolt to secure said clamping members together.

49. The clamping lock of claim 48 further including:

a yoke on said opposite side of said looped tie opening of said one of said clamping members to which said swing bolt is pivoted;

a pair of spaced fingers on said opposite side of said looped tie opening of said other clamping member for receiving said swing bolt therebetween; and adjustable means on said swing bolt engagable with said fingers to hold said clamping members together.

50. The clamping lock of claim 49 wherein said adjustable means includes:

a nut threadably received on said swing bolt; and flange means on said swing bolt movable into gripping engagement with said fingers by adjusting said nut to hold said clamping members together.

* * * * *